US005400509A

United States Patent [19]

Collins

[11] Patent Number: 5,400,509

[45] Date of Patent: Mar. 28, 1995

[54] FOLDING KNIFE WITH HIDEEN FRAME AND METHOD OF ASSEMBLY

[76] Inventor: Walter W. Collins, P.O. Box 100, North, S.C. 29112

[21] Appl. No.: 223,599

[22] Filed: Apr. 6, 1994

[51] Int. Cl.[6] ..... B26B 1/02

[52] U.S. Cl. ..... 30/161; 30/155; 29/434; 29/525.1

[58] Field of Search ..... 30/155, 158, 159, 160, 30/161, 164, 151; 7/118; 29/434, 525.1

[56] References Cited

U.S. PATENT DOCUMENTS

| | | | |
|---|---|---|---|
| 2,197,136 | 4/1940 | Share et al. | 30/159 |
| 3,783,509 | 1/1974 | Lake | 30/161 |
| 4,006,514 | 2/1977 | Penman | 30/161 |
| 4,268,960 | 5/1981 | Reinschreiber | 30/161 |

OTHER PUBLICATIONS

W. R. Case & Sons Cutlery advertisement, p. 52, Apr.-/May 1993 issue of *Blade Magazine.*

*Primary Examiner*—Richard K. Seidel
*Assistant Examiner*—Hwei-Siu Payer
*Attorney, Agent, or Firm*—Leatherwood Walker Todd & Mann

[57] ABSTRACT

A folding knife having an elongated, unitary blade carrier which is received within a blade carrier cavity of a unitary molded handle. The metal construction of the blade carrier provides a rigid, hidden frame structure for strengthening the knife. The combination of the unitary handle and unitary blade carrier allow for simplified construction. Covers are also provided in the handle for concealing a blade pivot pin.

11 Claims, 2 Drawing Sheets

FOLDING KNIFE WITH HIDEEN FRAME AND METHOD OF ASSEMBLY

BACKGROUND OF THE INVENTION

This invention relates generally to a folding knife having a blade pivotally carried within a frame, which in turn is carried within a handle.

Folding pocket knives come in a variety of configurations and styles. In recent years, molded knife handles have become popular for folding knives. Such handles, which can be molded out of a durable material, such as glass-filled nylon, can provide a serviceable handle for use with smaller folding knives. However, a metal structure may be desirable for use in holding the blade in a larger sized folding knife, such as folding hunting knives, to maximize the amount of force which can be applied with the blade during use without damaging the plastic handle. A metal structure for holding the blade also improves the weight and feel of such larger folding knives.

For manufacturing purposes, it is desirable to have a folding knife design which is attractive, easy to use, and of sturdy design and which is also relatively simple and cost-effective to construct.

Additionally desirable on folding knives is a feature for locking the knife blade in an extended position. Prior folding knife designs include U.S. Pat. No. 4,347,665, issued to Glesser, which discloses a pocket knife having a latch which is received in a notch. A leaf spring is provided for biasing the underside of a lock mechanism for securing the blade in an open position. U.S. Pat. No. 4,570,341, issued to Konneker, discloses a pocket knife having a lockbar, an end of which is received in a notch provided in the blade. A leaf spring is provided for biasing the lockbar. U.S. Pat. No. 5,044,079, issued to Gibbs, discloses a folding knife having two blades, a lock lever, and a lining member received between separate cover pieces.

While various folding knife designs are available, they may present limitations which interfere with an attractive and efficiently manufactured knife design.

SUMMARY OF THE INVENTION

It is the principal object of this invention to provide a folding knife having a hidden support frame carried within a unitary handle.

It is another object of the present invention to provide a folding knife of simplified manufacture.

It is another object of the present invention to provide a folding knife having a minimum number of parts.

It is still another object of the present invention to provide a folding knife having a concealed blade pivot pin.

It is yet another object of the present invention to provide a folding knife of simplified assembly.

It is still further an object of the present invention to provide a method of assembling a folding knife.

These and other aspects of the present invention will become further evident upon reference to the following drawings and accompanying specification.

Generally, one preferred embodiment of the present invention includes a folding knife having an elongated blade with a cutting edge and also an elongated blade carrier, having a substantially U-shaped cross-section, portion and which also defines a blade cavity. The blade is pivotally connected to the blade carrier for movement with respect to the blade carrier, and the blade is moveable from a retracted blade position, wherein the blade is received within the blade cavity of the blade carrier, to an extended blade position, wherein the blade is extended from the blade carrier. A longitudinally extending handle is provided defining a blade carrier cavity and a blade opening in communication with the blade carrier cavity. The blade carrier is fixedly received within the blade carrier cavity of the handle, such that the blade extends outwardly from the handle through the blade opening when the blade is in the extended position. Also provided are locking means associated with the blade carrier for automatically locking the blade in the extended position when the blade is pivoted to the extended position.

More specifically, the folding knife of the present invention may include an elongated lockbar pivotally connected to the blade carrier for automatically pivoting between a locking position, for engaging and locking the blade in the extended position, to a release position, for allowing the blade to be pivoted to the retracted position. Also, an elongated flexible rod is provided having one end thereof fixed in the handle and the other end thereof extending into the blade cavity of the blade carrier for selectively engaging the lockbar and urging the lockbar towards the locking position.

The present invention also includes a method of assembling a folding knife, comprising providing an elongated blade having a cutting edge, an elongated blade carrier, having a substantially U-shaped cross-section portion, and defining a blade cavity and a first pin opening, and a handle defining a blade carrier cavity, and a second pin. The blade carrier is inserted in the blade carrier cavity of the handle such that the first and second pin openings are substantially co-axially aligned, and a pivot pin is inserted into the first and second pin openings for securing the blade, the blade carrier and the handle together, such that the blade may pivot with respect to the blade carrier and the handle.

BRIEF DESCRIPTION OF THE DRAWINGS

The foregoing, as well as other objects of the present invention, will be further apparent from the following detailed description of the preferred embodiment of the invention, when taken together with the accompanying drawings, in which.

DESCRIPTION OF THE PREFERRED EMBODIMENT

Figure 1:
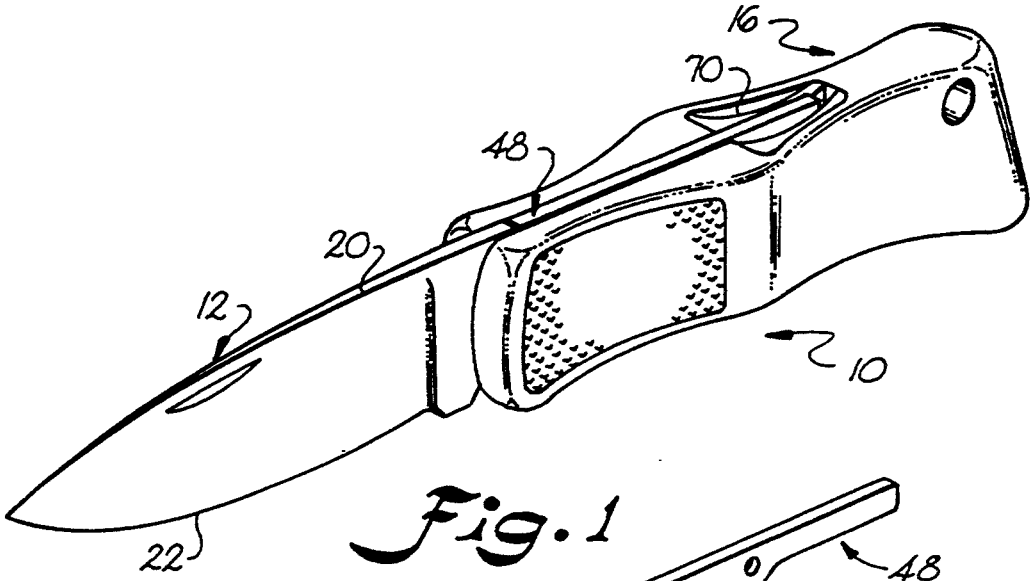
FIG. 1 is a perspective view of a folding knife constructed in accordance with the present invention.

Referring to the drawings in detail, wherein like reference characters represent like elements or features throughout the various views, the folding knife of the present invention is designated generally in the FIGS. 1 through 5 by reference character 10.

Figure 2:
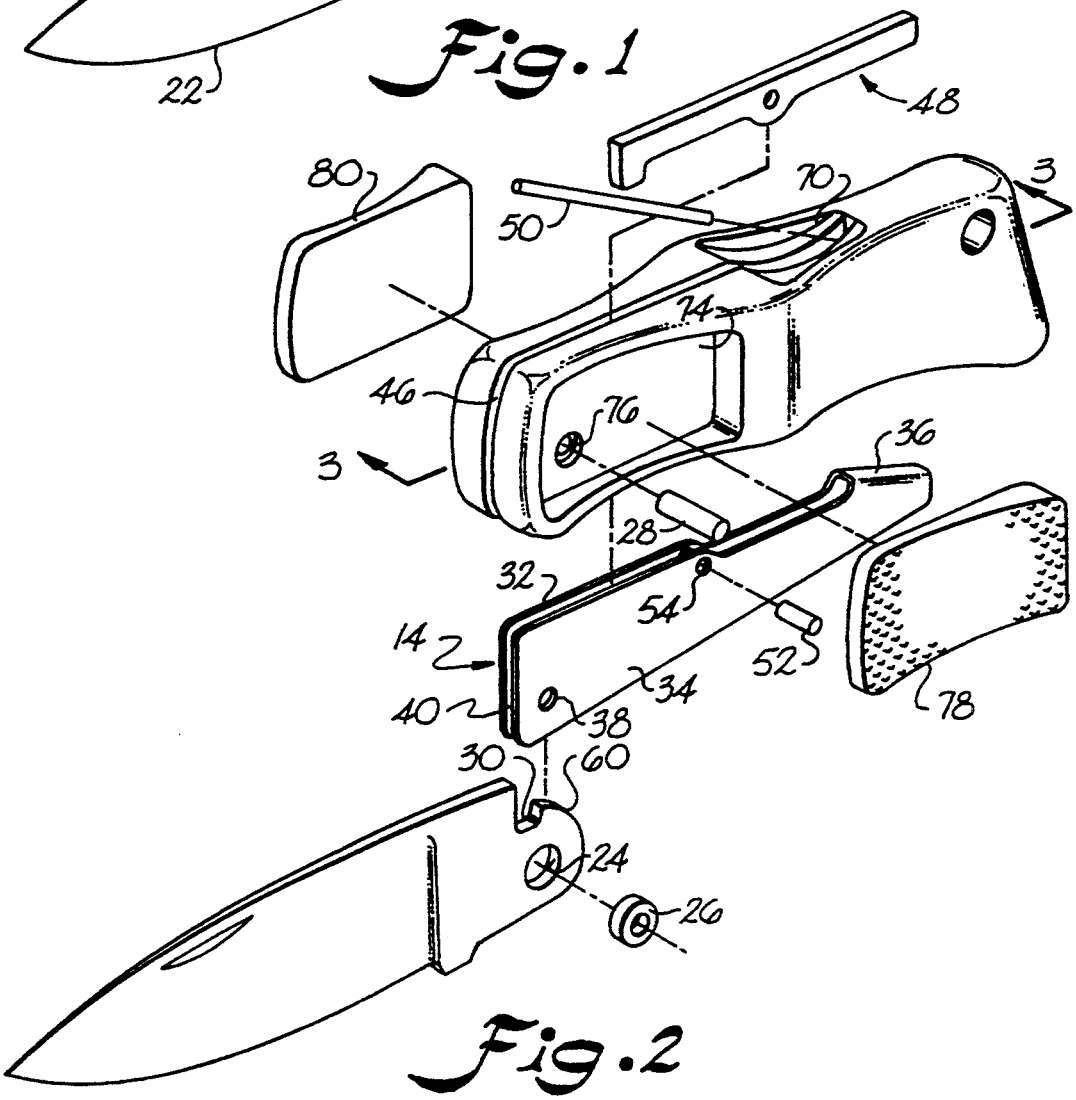
FIG. 2 is an exploded perspective view of a folding knife constructed in accordance with the present invention.
Figure 3:
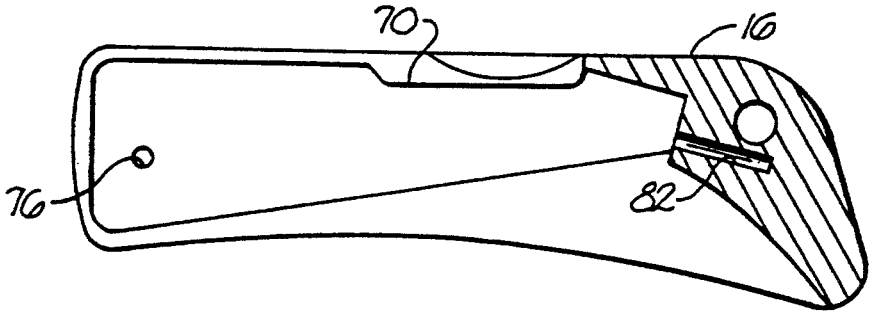
FIG. 3 is a sectional view taken along lines 3—3 of FIG. 2.

Folding knife 10 includes an elongated blade, generally 12, an elongated blade carrier, generally 14 (as best seen in FIG. 2), a longitudinally extending handle, generally 16, and locking means, generally 18. Elongated blade 12 has an upper edge 20 and a sharpened, cutting edge 22 opposite upper edge 20. Blade 12 includes a pivot pin receiving opening 24 in which a bushing 26 is carried. A pivot pin 28 is provided for receipt in bushing 26 for pivotally connecting blade 12 to handle 16, in a manner to be discussed in more detail below.

Blade 12 also defines a notch 30 in an upper portion thereof near pivot pin opening 24. Blade carrier 14 is preferably constructed of stainless steel, although any other suitable metal, or other substantially rigid material, could also be used. Blade carrier 14 includes two elongated panels 32, 34, which extend substantially parallel to one another. Panels 32, 34 are joined together by a bridging portion 36, which provides for a substantially U-shaped cross section of blade carrier 14 in the bridging member 36 section thereof.

Figure 4:
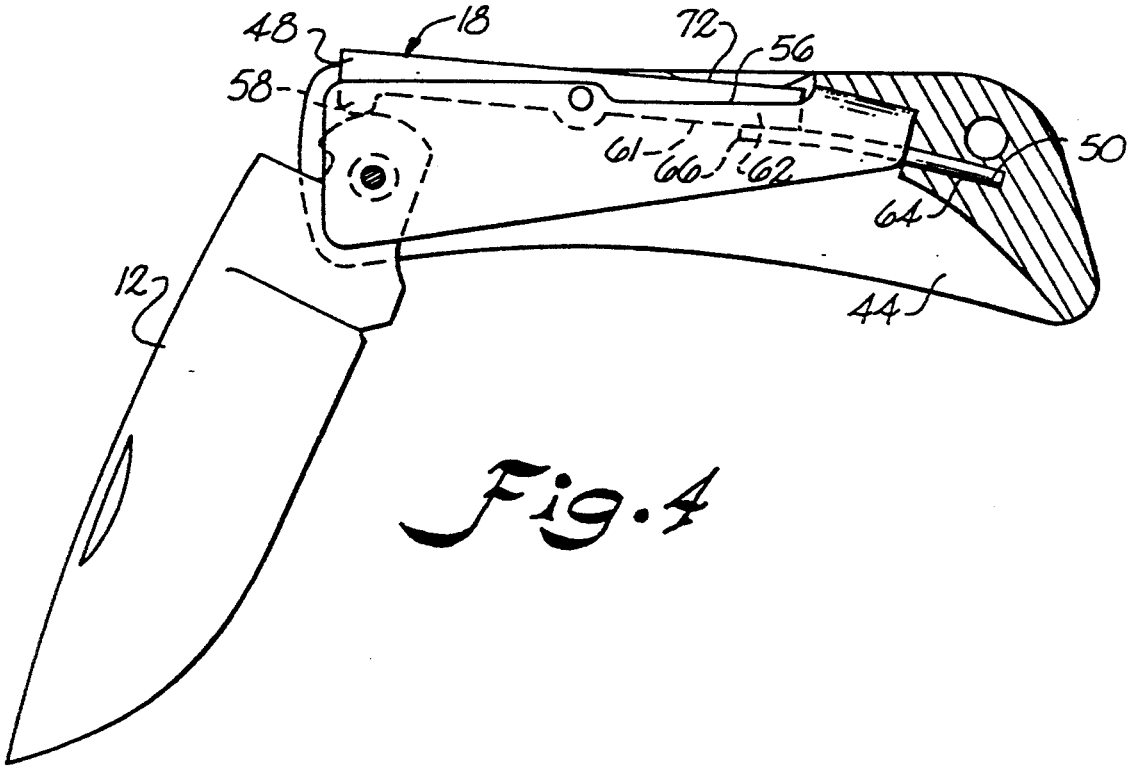
FIG. 4 is a sectional view of a folding knife constructed in accordance with the present invention, illustrating the blade in a partially opened state.
Figure 5:
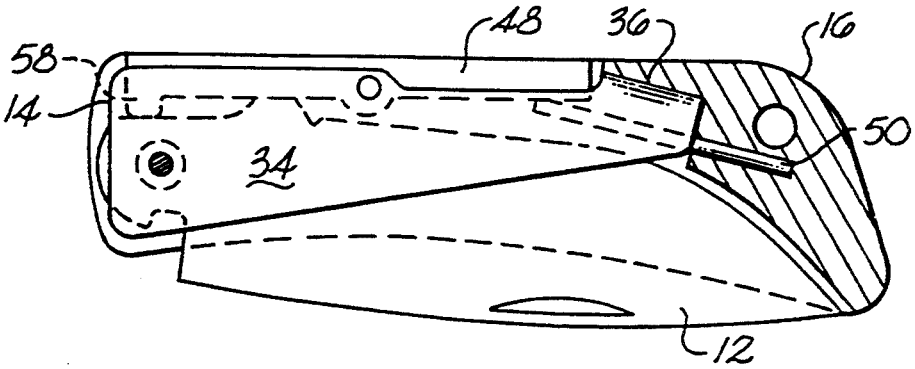
FIG. 5 is a sectional view of a folding knife constructed in accordance with the present invention, illustrating the blade in a retracted state.

Blade carrier 14 includes a pivot pin opening 38 being provided in each of panels 32, 34 (only one opening 38 being shown), with such openings 38 being coaxial with respect to one another. When pivot pin 28 is inserted in bushing 26, and bushing 26 is in turn inserted into opening 24 of blade 12, and when pin 28 is received by openings 38 of panels 32, 34 of blade carrier 14, blade 12 is then carried by and is permitted to pivot with respect to blade carrier 14. Blade 12 is pivotable between an extended position, as shown in FIG. 1, to a retracted position, as shown in FIG. 5, and to an intermediate position therebetween, as shown in FIG. 4. When blade 12 is in its retracted position, a substantial portion of blade 12 is received within a blade cavity 40 provided in blade carrier 14, which is defined by panels 32, 34 in conjunction with bridging member 36. By pivotally attaching blade 12 to blade carrier 14, a rigid metal-on-metal construction interface is provided between blade 12 and blade carrier 14. This metal-on-metal construction permits a large amount of force to be provided on blade 12 during use, even though knife 10 is, from an outward appearance, simply a knife with a molded handle.

Handle 16 includes a blade cavity 44 for receiving blade carrier 14. Handle 16 is configured such that blade carrier 14 is virtually concealed within handle 16 when the knife 10 is fully constructed. Handle 16 also includes a blade opening 46 for receipt of blade 12 when blade 12 is in an extended or intermediate position.

Locking means 18 provided in handle 16 includes primarily a tumbler, or lockbar, 48, a spring biasing member such as flexible wire or shaft 50, and a pivot pin 52, which is received in openings 54 coaxially provided in each of panels 32, 34 of blade carrier 14. Upon assembly of knife 10, lockbar 48 is pivotable within a slot 56 provided in the upper portion of blade carrier 14 between a locking position, wherein a downwardly extending locking tab 58 of lockbar 48 engages with notch 30 of blade 12 to automatically lock blade 12 in an extended position, and to a release position, for allowing blade 12 to be pivoted to its retracted position within handle 16. As blade 12 is moved from its retracted position to its extended position, tab 58 rides on a cam surface 60 of blade 12 until tab 58 is received within notch 30. Tab 58 is urged toward its locking position by virtue of spring post 50 which engages on the underside 61 of end 62 of lockbar 48, opposite tab 58. Spring post 50 is a cantilevered spring, having one end 64 fixedly received within handle 16 and the other end 66 being cantilevered and urging upwardly against end 62 of lockbar 48 for constantly urging lockbar 48 to its locking position. It is to be understood that a variety of other spring means could be used, such as a leaf spring, torsion spring, coil spring, or the like. Also, it is to be understood that because blade 12 is automatically locked into place once it is in its extended position by virtue of the spring pressure applied to lockbar 48 by spring post 50, accidental closure of blade 12 is substantially prevented.

Once blade 12 is in its extended position, to allow blade 12 to be pivoted to its retracted position, lockbar 48 must be moved to its release position. This is accomplished through use of a release recess 70 defined in an upper portion of handle 16. Release recess 70 allows access of the knife user's finger against an upper surface 72 of lockbar 48 such that the user can depress surface 72 to overcome the spring force of spring post 50, which in turn causes locking tab 58 to move upwardly out of engagement with notch 30 of blade 12. The user would then, while surface 72 of lockbar 48 is depressed, rotate blade 12 by hand into its retracted position.

It is to be understood that each blade carrier 14 and handle 16 are each of unitary, or one piece, construction. Handle 16 is preferably molded of glass-filled nylon, although any other suitable plastic, wood,or metal material could be used. Because of the high production rates allowed by having a one-piece molded handle such as handle 16, production costs of knife 10 can be reduced. Also, by virtue of the unitary construction of blade carrier 14, manufacturing steps in welding, riveting, or otherwise fixing together a frame structure for a blade is eliminated.

Each side of handle 16 also preferably defines an access recess 74 (only one being shown). Defined in each access recess 74 is a pivot pin opening 76 for receipt of blade pivot pin 28.

Upon assembly of knife 10, spring post 50 is inserted into bore 82 of handle 16. Blade 12 and lockbar 48 are inserted into blade carrier 14 to form a subassembly, which is then inserted into blade carrier cavity 44 of handle 16. Pivot pin 28 is then placed within opening 76 and through bushing 26 of blade 12. It is to be understood, of course, that bushing 26 could be eliminated, if desired, with pin 28 being the sole item received by bore 24 of blade 12. Also, pin 28 is preferably constructed in the form of a two piece, two-headed rivet-type fastener (not shown), wherein the heads of such fastener substantially retain pin 28 within handle 16 and carrier 14.

After pin 28 has been inserted through opening 76 of handle and through blade 12, access recess covers 78, 80 are then inserted within access recesses 74 on each side of handle 16. Access recess covers are preferably bonded to handle 16 within access recesses 74 through use of a suitable adhesive, such that once covers 78, 80 are in place, covers 78, 80 are substantially flush with the sides of handle 16, and pin 28 is captured within handle 16 permanently. Such a construction yields a streamlined handle, with the pivot pin of the blade being totally concealed from view.

Release recess 70 is configured such that during actual use of knife 10, the flesh of the user's hand would not penetrate recess 70 to an extent necessary to release blade 12 from its locked, extended position. The recess 70 is configured such that release of blade 12 requires the deliberate use of the finger of the user, thereby avoiding accidental closure of blade 12 during use.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

It is claimed:

1. A folding knife, comprising an elongated blade having a cutting edge;

an elongated unitary blade carrier having a substantially U-shaped cross-section portion and defining a blade cavity, said blade being pivotally connected to said blade carrier for movement with respect to said blade carrier; said blade being moveable from a retracted blade position, wherein said blade is received within said blade cavity of said blade carrier, to an extended blade position, wherein said blade is extended from said blade carrier;

a longitudinally extending unitary handle defining a blade carrier cavity and a blade opening in communication with said blade carrier cavity, said blade carrier being fixedly received within said blade carrier cavity of said handle, such that said blade extends outwardly from said handle through said blade opening when in said extended position;

an elongated lockbar pivotally connected to said blade carrier for automatically pivoting between a locking position, for engaging and locking said blade in said extended position, to a release position, for allowing said blade to be pivoted to said retracted position; and an elongated spring member having one end thereof fixed by said handle and the other end thereof extending into said blade cavity of said blade carrier for engaging said lockbar and urging said lockbar towards said locking position.

2. A folding knife, comprising an elongated blade having a cutting edge;

an elongated blade carrier having a substantially U-shaped cross-section portion and defining a blade cavity, said blade being pivotally connected to said blade carrier for movement with respect to said blade carrier; said blade being moveable from a retracted blade position, wherein said blade is received within said blade cavity of said blade carrier, to an extended blade position, wherein said blade is extended from said blade carrier;

a longitudinally extending handle defining a blade carrier cavity and a blade opening in communication with said blade carrier cavity, said blade carrier being fixedly received within said blade carrier cavity of said handle, such that said blade extends outwardly from said handle through said blade opening when in said extended position; and locking means attached to said blade carrier for automatically locking said blade in said extended position when said blade is pivoted to said extended position.

3. A folding knife as defined in claim 2, wherein said locking means comprises an elongated lockbar pivotally connected to said blade carrier for pivoting between a locking position, for engaging and locking said blade in said extended position, to a release position, for allowing said blade to be pivoted to said retracted position.

4. A folding knife as defined in claim 3, further comprising spring biasing means associated with said lockbar for urging said lockbar to said locking position.

5. A folding knife as defined in claim 4, wherein said spring biasing means comprises an elongated flexible rod having one end thereof fixed in said handle and the other end thereof extending into said blade cavity of said blade carrier for engaging said lockbar.

6. A folding knife as defined in claim 3, wherein said blade carrier defines a lockbar slot for receiving and for allowing pivoting of said lockbar.

7. A folding knife as defined in claim 3, wherein said handle defines a release recess for allowing external access to said lockbar to provide for depression of said lockbar through said release recess, such that said lockbar may be pivoted from said locking position to said release position.

8. A folding knife as defined in claim 2, further comprising;

a pivot pin received by both said blade and said blade carrier about which said blade pivots;

said handle defining at least one access recess adjacent said pivot pin;

said handle defining a pin opening in said access recess for receiving said pivot pin; and an access recess cover received in said access recess for both concealing said pivot pin from view and for retaining said pivot pin in said blade and in said blade carrier.

9. A method of assembling a folding knife, comprising:

providing an elongated blade having a cutting edge;

providing an elongated blade carrier having a substantially U-shaped cross-section portion and defining a blade cavity and a first pin opening;

providing a handle defining a blade carrier cavity and a second pin opening;

inserting said blade carrier in said blade carrier cavity of said handle such that said first and second pin openings are substantially co-axially aligned; and inserting a pivot pin into said first and second pin openings for securing said blade, said blade carrier and said handle together, such that said blade may pivot with respect to said blade carrier and said handle.

10. A method of assembling a folding knife as defined in claim 9, further comprising:

providing a lockbar for locking said blade; and pivotally connecting said lockbar to said blade carrier prior to inserting said blade carrier into said blade carrier cavity of said handle.

11. A method of assembling a folding knife as defined in claim 9, further comprising:

providing a pin cover; and fixing said pin cover to said handle and covering said second pin opening with said pin cover.

* * * * *